US005129167A

United States Patent [19]

Nakahara

[11] Patent Number: 5,129,167

[45] Date of Patent: Jul. 14, 1992

[54] METHOD OF AND APPARATUS FOR PREVENTING DIFFUSION OF MUDDY WATER IN SAND GATHERING EQUIPMENT

[75] Inventor: Tatsuo Nakahara, Tokyo, Japan

[73] Assignee: Ikikaihatu Yugen Kaisya, Japan

[21] Appl. No.: 737,849

[22] Filed: Jul. 30, 1991

Related U.S. Application Data

[63] Continuation of Ser. No. 567,779, Aug. 15, 1990, abandoned.

[30] Foreign Application Priority Data

Aug. 29, 1989 [JP] Japan ..... 1-222505
Feb. 28, 1990 [JP] Japan ..... 2-48528

[51] Int. Cl.[5] ..... E02F 3/88

[52] U.S. Cl. ..... 37/58; 37/61; 406/183; 406/109

[58] Field of Search ..... 37/58, 59, 61-63, 37/75-76; 406/157-158, 168, 171, 175, 39, 93, 106, 113, 183, 109

[56] References Cited

U.S. PATENT DOCUMENTS

| | | | |
|---|---|---|---|
| 669,192 | 3/1901 | Whisler | 37/62 |
| 909,543 | 1/1909 | Carlesimo | 37/62 X |
| 1,264,688 | 4/1918 | Schilling | 406/106 X |
| 1,415,113 | 5/1922 | Phillips, Jr. | 37/62 X |
| 1,520,945 | 12/1924 | Greisemer | 37/62 |
| 2,019,968 | 11/1935 | Holloway | 37/62 |
| 2,044,088 | 6/1936 | Lord | 37/62 X |
| 2,076,823 | 4/1937 | Newell | 37/62 |
| 3,139,932 | 7/1964 | Johnson | 406/183 |
| 3,975,842 | 8/1976 | Andreae | 37/58 |
| 4,053,181 | 10/1977 | Saito . | |
| 4,506,704 | 3/1985 | Boom et al. | 406/183 |
| 4,760,656 | 8/1988 | East | 37/57 |
| 4,807,373 | 2/1989 | Sloan et al. | 37/58 X |
| 4,854,058 | 8/1989 | Sloan et al. | 37/58 X |

FOREIGN PATENT DOCUMENTS 836101 6/1960 United Kingdom .

*Primary Examiner*—Randolph A. Reese
*Assistant Examiner*—Spencer Warnick
*Attorney, Agent, or Firm*—Oliff & Berridge

[57] ABSTRACT

A sand gathering system has a submerged sand pump capable of sucking slurry such as sand and gravel from the bottom of sea, lake, pond or the like, a sedimentation tank disposed at the discharge opening of the suction pump, and a discharge tank for discharging the muddy water separated from the sand slurry in the sedimentation tank. This system is operated such that the muddy water separated from the slurry is discharged to a region near the bottom of the sea, so that the muddy water is not diffused to the surface region of the sea water. To this end, the sand gathering system has an apparatus for preventing diffusion of the muddy water. The apparatus comprises a discharge pump connected to the discharge portion of the discharge tank and a discharge pipe connected to the discharge opening of the discharge pump and leading to a region near the bottom of the sea, lake, pond or the like. The discharge pipe may be constructed as a unit with the sand transfer line leading from the submerged sand pump or may be fixed thereto such that the discharge opening formed in the end of the discharge pipe is located in the vicinity of the suction opening of the sand pump so that the muddy water may be recycled through the sand gathering system.

11 Claims, 9 Drawing Sheets

METHOD OF AND APPARATUS FOR PREVENTING DIFFUSION OF MUDDY WATER IN SAND GATHERING EQUIPMENT

This is a continuation of U.S. application Ser. No. 07/567,779 filed Aug. 15, 1990, now abandoned.

BACKGROUND OF THE INVENTION

1. Field of the Invention

The present invention relates to a method of and an apparatus for preventing diffusion of muddy water in equipment for gathering sand. More particularly, the present invention is concerned with a method of and an apparatus for preventing diffusion of muddy water in a system for gathering sand from the bottom of a lake, river or sea.

2. Description of the Related Art

FIG. 10 illustrates a known system for gathering sand from the sea bottom. A sand gathering boat 1 has a sand pump 5 which can be extended down to the sea bottom through a hose 3 and a sand pipe 4. In operation, wires are paid off from davits 6 on the boat 1 after anchorage of the boat 1 so as to situate the sand pump 5 on the sea bottom. Then, the sand pump 5 is operated to suck the sand from the sea bottom in the form of slurry. The sand pump 5 is operated by a hydraulic or an electric motor directly connected to the sand pump 5.

The water sucked from the sea bottom and containing soil and sand is delivered to a sieving apparatus 7 on the boat 1 through the sand pipe 4 and the hose 3. The sieving apparatus 7 is provided with a metal gauze wire 8 which separates shells and other matters from the water containing sand grains. The water containing sand grains, which has passed the metal gauze wire 8, is introduced into a sand tank 10 through a chute 9. Coarse sand grains 11 which are liable to precipitate are accumulated on the bottom of the tank 10 so as to lay under muddy water 12 comprising suspended fine particles of mud, clay and sand.

A discharge tank 13 is provided on a corner of the sand tank 10, so as to communicate with the sand tank 10 through a gate 14. As the gate 14 is opened, the muddy water 12 flows into the discharge tank 13. Then, as a gate valve 15 is opened, muddy water 12 is discharged to the surface of the sea through a water discharge opening 16 provided at the bottom of the water discharge tank 13 and then through a discharge opening 17 which opens in one side of the shell of the sand gathering boat 1.

In this known sand gathering system, since the muddy water 12 is discharged outboard from the discharge opening which opens in a portion of the boat shell near the sea water level, fine particles of mud, clay and sand contained in the muddy water 12 are diffused into the sea water without sedimentation. The diffused fine particles contaminate the sea water around the boat and are moved by the tide to culture areas for cultivating marine creatures such as shells and fishes, thereby seriously damaging such marine creatures.

In addition to the basic problem described above, the conventional sand gathering system has suffered from a problem in that the suction mouth of the suction opening is clogged with sand even when the suction pump is operated with its full power, particularly when the slurry to be sucked has a high concentration of soil and sand. This problem would be overcome by increasing the power of the suction pump. Such a suction pump having a large power, however, is inefficient from an economical point of view, because only a small part of power is used when the concentration of sand in the slurry is low. Furthermore, the known sand gathering system relying upon a sole suction pump requires a priming of the suction line when the pump is started, thus requiring troublesome work.

Furthermore, fine particles of sand are returned to the sea. Therefore, the sand gathered from the sea bottom by this known sand gathering system exhibits an inferior particle size distribution as compared with sand acquired from land area or from a river bottom, so that the quality of this sand, when used as aggregate for concrete, is inferior to those of sand acquired from land area and river bottom. In order to increase sand gathering capacity, it is necessary to employ a suction pump having a greater capacity. As mentioned above, however, the use of a suction pump having a too large capacity is not recommended from an economical point of view. Thus, it has not been allowed to unlimitedly increase the capacity of the pump on the boat.

SUMMARY OF THE INVENTION

Accordingly, a first object of the present invention is to provide a method of and an apparatus for preventing diffusion of muddy water in a sand gathering system, capable of preventing contamination of water around the sand gathering system caused by discharge of muddy water after separation of the sand.

A second object of the present invention is to provide a method of and an apparatus for preventing diffusion of muddy water in a sand gathering system in which, in addition to prevention of contamination of water caused by discharge of separated muddy water, advantages are brought about in that sand particles of small particle sizes are returned to the sedimentation tank so as to improve the sand gathering efficiency and in that clogging of the suction line is effectively prevented and the operation is facilitated so as to offer an increased suction capacity without requiring any increase in the capacity of the suction pump.

A third object of the present invention is to provide a method of and an apparatus for preventing diffusion of muddy water in a sand gathering system, capable of ensuring a uniform particle size distribution of the gathered sand.

A fourth object of the present invention is to provide an apparatus for preventing diffusion of muddy water in a sand gathering system, employing a discharge system which discharges the water separated from the gathered sand and gravel to the bottom of, for example, the sea, without requiring any driving means and without encountering problems such as interference with suspension wires suspending submerged pump and hydrodynamic resistance.

To these ends, according to one aspect of the present invention, there is provided a method of preventing diffusion of muddy water in a sand gathering system in which slurry of sand gravel and so forth on the bottom of sea, lake, pond or the like is sucked together with water and supplied into a sedimentation tank and the water separated from the gathered slurry is discharged, the method characterized in that the separated water is forcibly discharged to the region near the bottom of the sea, lake, pond or the like. In this method, the water separated from the slurry is discharged to a region near the submerged suction opening of the suction means so as to be sucked and recycled through the sand gathering system.

According to another aspect of the present invention, there is provided an apparatus for preventing diffusion of muddy water in a sand gathering system of the type having a suction pump capable of sucking slurry such as sand and gravel from the bottom of sea, lake, pond or the like, a sedimentation tank disposed at the discharge opening of the suction pump, and a discharge portion for discharging the water separated from the slurry in the sedimentation tank, the apparatus comprising: a discharge pump connected to the discharge portion; and a discharge pipe connected to the discharge opening of the discharge pump and leading to a region near the bottom of the sea, lake, pond or the like. According to this arrangement, the separated water is forcibly discharged to the bottom region so that diffusion of contaminant in the surface region is prevented.

In another form of the invention, there is provided an apparatus for preventing diffusion of muddy water in a sand gathering system of the type having a suction pump capable of sucking slurry such as sand and gravel from the bottom of sea, lake, pond or the like, a sedimentation tank disposed at the discharge opening of the suction pump, and a discharge portion for discharging the water separated from the slurry in the sedimentation tank, the apparatus comprising: a discharge pump connected to the discharge portion; and a discharge pipe connected to the discharge opening of the discharge pump and leading to a region near the submerged suction opening of the suction pump. The discharge pipe may be directly connected to a portion near the suction opening of said suction pump so as to be moved together therewith, or may be connected to the submerged suction opening of the suction pump through a connection means such as a chain so as to be located within a predetermined distance from the suction opening of the suction pump. The arrangement also may be such that the discharge pipe is led to the suction opening of the suction pump along a sand transfer pipe which leads from the suction opening of the suction pump to the sedimentation tank.

In the sand gathering system employing the method or apparatus of the invention described before, slurry of sand, gravel and so forth on the bottom of sea, lake, pond or the like is sucked together with water and is supplied to a sedimentation tank where muddy water (i.e., water separated from the suspension tank and suspending sludge and fine particles of mud and sand; hereinafter referred to as "muddy water") is forcibly discharged by the discharge pump to the region near the bottom of the sea or the like. Consequently, the particles suspended by the discharged muddy water are allowed to precipitate without being diffused in the water. Consequently, the spread of the muddy water to the culture area by tide is effectively avoided. When the discharge opening of the discharge pipe is led to and opened in a region near the suction opening of the submerged suction pump, the muddy water is discharged deep from the water surface so that the fine particles suspended in the muddy water are allowed to precipitate without being diffused in the surface region, whereby the unfavorable effect encountered when the muddy water is discharged to a surface region is avoided. In addition, the release of the muddy water to the exterior of the sand gathering system is minimized because of recycling of the muddy water through the sand gathering system. The recycling of the muddy water also offers an advantage in that the yield is improved due to sedimentation of fine particles of sand. When the discharge end of the discharge pipe is connected to the portion of the suction pump near the suction opening thereof, the above-described advantages are enjoyed even when the sand is gathered from a very deep region under the water level.

When the discharge pipe is extended from the discharge portion on the boat to the region near the suction opening the suction pump along the sand transfer line leading from the pump suction opening to the sedimentation tank, the discharge pipe can easily be handled as a unit with the sand transfer line without encountering resistance produced by water. In addition, it is possible to position the discharge opening of the discharge pipe near the suction opening for sucking the sand. Although it is preferred that the discharge opening is positioned in close proximity of the sand suction opening to allow the recycling of the separated muddy water, this is not exclusive and the discharge pipe may be opened to the ambient water at an intermediate portion of the sand transfer pipe so as to directly release the muddy water into the ambient water, provided that the opening of the discharge pipe is positioned at a depth which is large enough to prevent diffusion of the muddy water in the surface region. It is also possible to integrate the discharge pipe with the sand transfer pipe by employing a double-walled pipe structure. In such a case, the resistance produced by water during handling of the pipes is greatly reduced to remarkably facilitate the handling.

In a specific form of the invention, the discharge pipe is provided with a shunt valve through which an ejector shunts from the discharge line leading to the discharge end opening, the ejector having an opening disposed in the suction opening of the suction pipe and directed in the sucking direction.

This arrangement is effective specifically in suppressing contamination of water in the surface region, while offering additional advantages such as minimization of release of the muddy water to the exterior of the sand gathering system and increase in the yield owing to the sedimentation of fine sand particles. The ejector pipe opens in the suction opening of the suction pump. When the slurry has a high concentration of sand and soil, it is difficult to suck the slurry by the suction power produced by the suction pump alone. In such a case, the shunt valve is operated to discharge the muddy water through the ejector pipe so as to assist the suction pump, thereby preventing clogging with sand and cleaning the suction end of the pump.

Thus, the method and apparatus of the invention for preventing diffusion of muddy water in a sand gathering system offers various advantages such as prevention of contamination in the surface region of the ambient water which may otherwise be caused by diffusion of muddy water separated from the slurry, and uniform particle size distribution of the gathered sand. Furthermore, it is possible to improve the gathering efficiency by sedimentation of fine sand particles by virtue of the recycling of the muddy water suspending such fine particles. Furthermore, the suction power of the pump can be increased without requiring the size of the pump to increase, so as to prevent clogging at the suction side of the pump while enabling cleaning of the suction side of the pump.

DESCRIPTION OF THE PREFERRED EMBODIMENTS

A detailed description will be given with reference to the accompanying drawings as to practical embodiments of the method and apparatus of the invention for preventing diffusion of muddy water in a sand gathering system.

Figure 1:
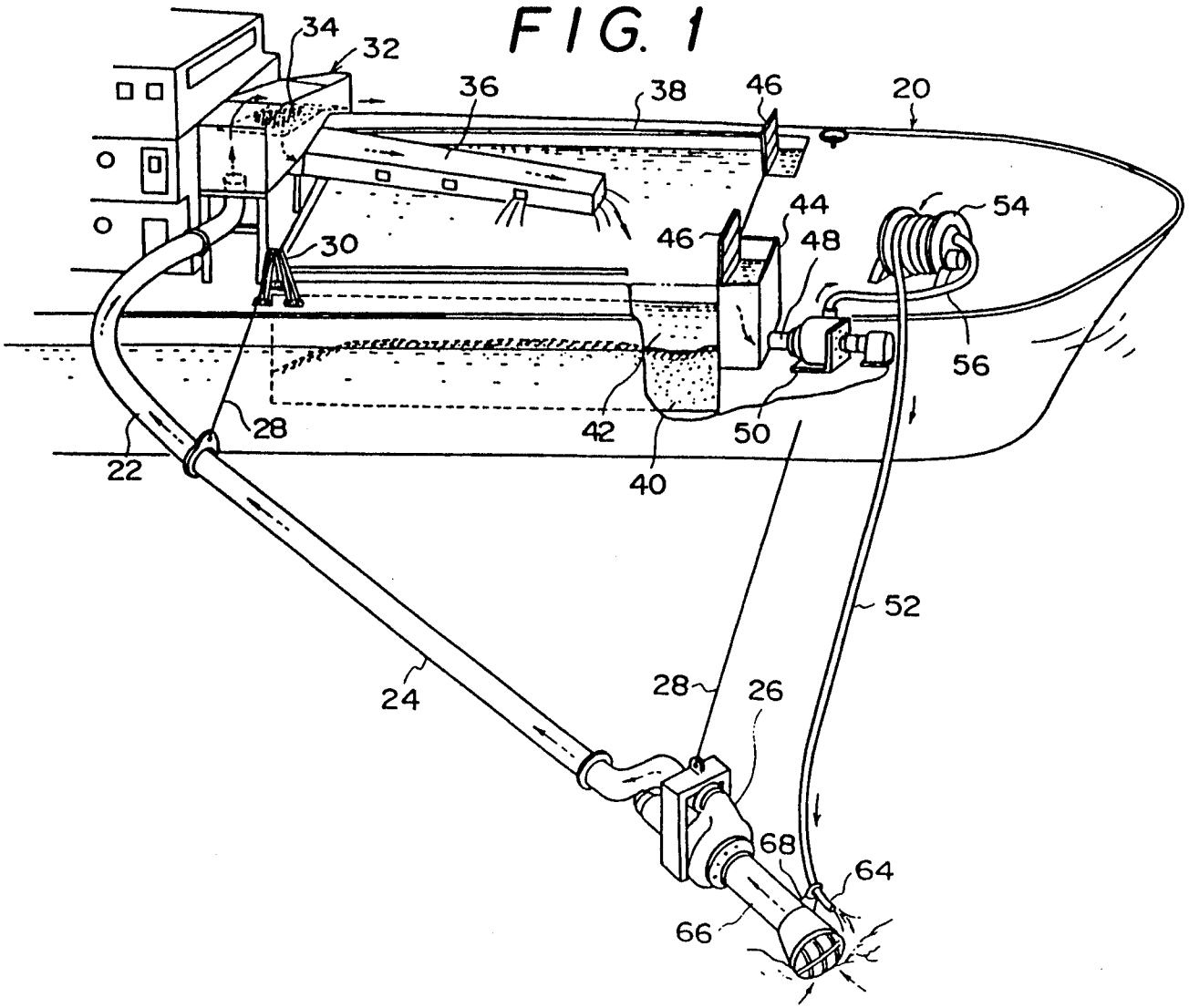
FIG. 1 is a perspective view of a first embodiment of the apparatus of the present invention for preventing diffusion of muddy water in a sand gathering system.

FIG. 1 shows a an apparatus for carrying out the method of the invention for preventing diffusion of muddy water applied to a system for gathering sand from the sea bottom.

A sand gathering boat 20 is provided with a suction system including a sand transfer line composed of a flexible movable hose 22 and a steel sand transfer pipe 24, and a suction sand pump 26 connected to an end of this suction pipeline. The sand pump 26 is adapted to be seated on the sea bottom as suspension wires 28 connected to the sand transfer line are released from davits 30 on the boat, so as to suck the sand on the sea bottom in the form of slurry. The boat 20 also has a sieving device 32 for sieving and classifying large-sized matters such as shells from the slurry sucked up by the suction system. This sieving device 32 has a tank having a metal gauze wire 34 which divides the interior of the tank into upper and lower sections. The metal gauze wire is 34 inclined so that large-sized matters separated by this metal gauze wire 34 are allowed to roll into the sea. Meanwhile, the water-containing sand slurry which has passed through the sieving device 32 is relieved into a sand tank 38 through a chute 36. The sand tank 38 is a large-sized tank which allows sedimentation so that coarse or large sand particles 40 are separated to accumulate on the bottom of the tank 38, while muddy water 42 containing fine particles of sand and soil stagnates on the accumulated coarse sand particles 40. The sand tank 38 is provided with a water discharge tank 44 which is communicated with the interior of the sand tank 38 through a gate 46 which allows only the muddy water 42 to be moved from the sand tank 38 into the discharge tank 44.

In this embodiment, the sand gathering system has a discharge pump 50 connected to a discharge opening 48 of the discharge tank 44. The discharge pump 50 has a capacity substantially the same as that of the sand pump 26 to forcibly discharge the muddy water 42 from the discharge tank 44. A discharge hose 52 is connected to the discharge end of the discharge pump 50. The discharge hose 52 is an elongated hose which is normally wound on a take-up drum 54 on board. When the suspension wires are released to lower the sand pump 26 deeper into the sea, the take-up drum 54 also is rotated to extend the discharge hose 52 to enable the discharge opening of this hose 52 to be held in the vicinity of the suction opening of the sand pump 26.

Figure 2:
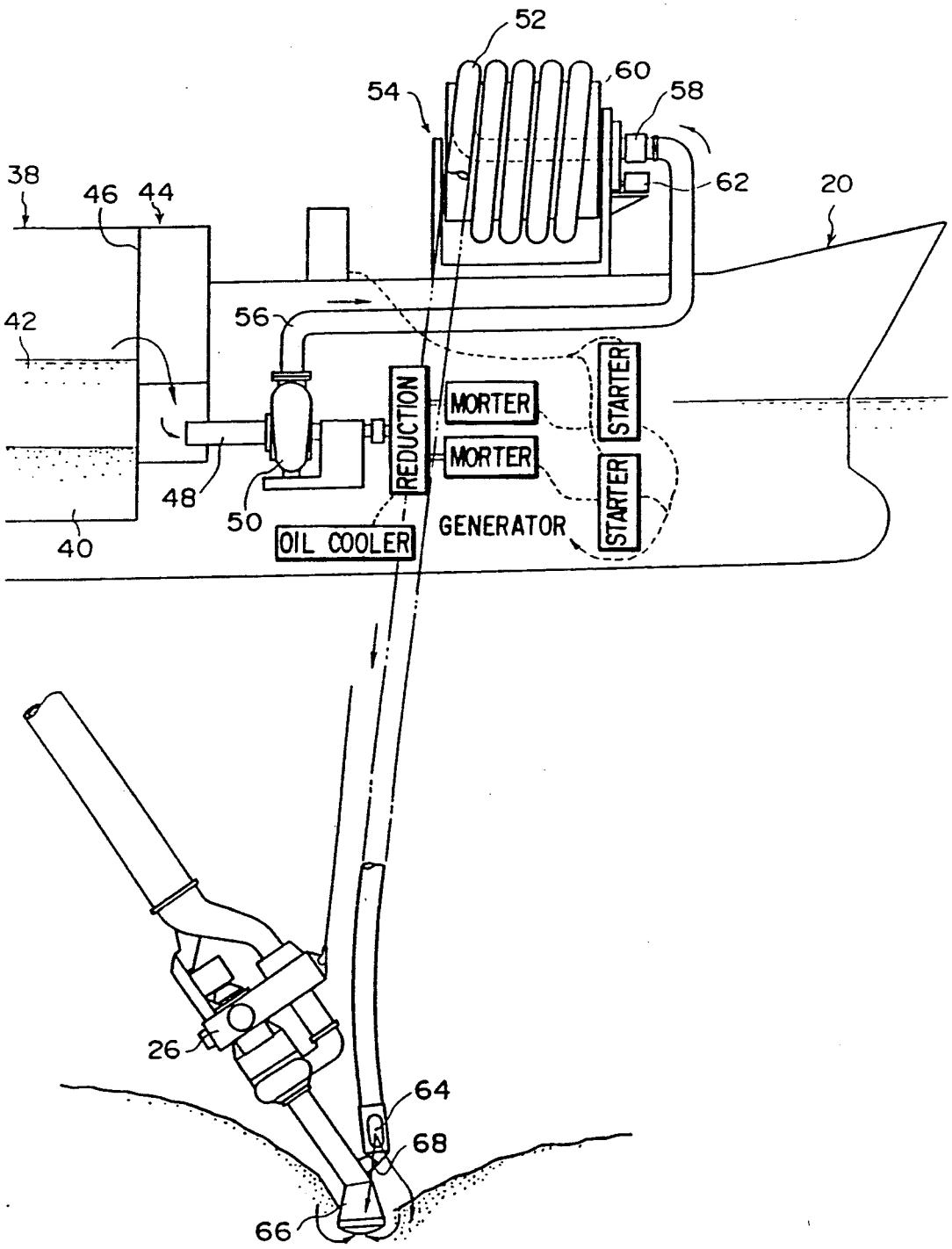
FIG. 2 is a side elevational view of a critical portion of the apparatus shown in FIG. 1.

FIG. 2 shows a practical arrangement for holding and releasing the discharge hose 52. As will be seen from this Figure, a discharge tube 56 made of steel is directly connected at its one end to the discharge port of the discharge pump 50, while the other end of the discharge tube 56 is connected to a swivel joint 58 provided on the rotary shaft portion of the take-up drum 54. The take-up drum 54 has; reel 60 on which is wound the discharge hose 52 whose one end is connected to the swivel joint 58 so that the other end of the discharge hose 52 can be extended in any desired direction. The reel 60 is rotatingly driven in one and the other direction by a hydraulic motor 62, thereby to release and take-up the discharge hose 52. The end of the discharge hose 52, having a discharge opening 64, is directly connected through a connecting jig 68 to a suction mouth 66 which forms the suction opening of the sand pump 26 so as to discharge muddy water 42 from the discharge tank 44 into the suction mouth 66.

The sand gathering operation of the described sand gathering system, which is provided with the apparatus of the invention for preventing diffusion of muddy water, will be described hereinunder. The davits 30 on the boat 20 are operated to release the wires 28 so that the sand pump 26 connected to the end of the sand transfer line is seated on the sea bottom. The discharge end of the discharge hose 52, which is connected to the discharge pump 50, is coupled to the suction mouth 66 of the sand pump 26 as explained before. Therefore, as the hydraulic motor 62 operates, the end discharge opening 64 of the discharge hose 52 is lowered following up the downward movement of the suction mouth 66 so as to be set at the same depth as the suction mouth 66 from the surface. As the sand pump 26 operates in this state, sand is sucked up together with sea water, so that the level of the muddy water 42 suspending fine particles of soil and sand rises in the sand tank 38. When the level of the muddy water 42 in the sand tank 38 has reached a predetermined level, the gate 46 is opened so that the muddy water 42 flows from the sand tank 38 into the discharge tank 44 to fill the latter. Then, the discharge pump 50 is started so that the muddy water 42 is forwarded toward the sea bottom through the suction hose 52 and is discharged into the ambient water in a region near the suction mouth 66. The greater the depth of the suction mouth 66 from the sea surface, the smaller the tendency for the muddy water 42 to be diffused to the surface region of the sea water. The thus discharged muddy water 42 is sucked again by the suction pump 26 due to the sucking power developed in the suction mouth 66, and is delivered again to the sand tank 38.

As will be understood from the foregoing description, according to the described embodiment of the invention, the external relief of the muddy water 42 is substantially nullified so as to eliminate troubles such as contamination of the surface region of the sea and damaging of marine products such as fishes in a fishery area. The recycling of the muddy water 42 also produces an advantage in that fine sand particles which generally exhibit a slow sedimentation speed are allowed to precipitate. Consequently, a uniform particle size distribution is obtained in the gathered sand, rather than non-uniform distribution rich in the coarse sand particles 40, whereby the quality and commercial value of the sand are enhanced.

Figure 3:
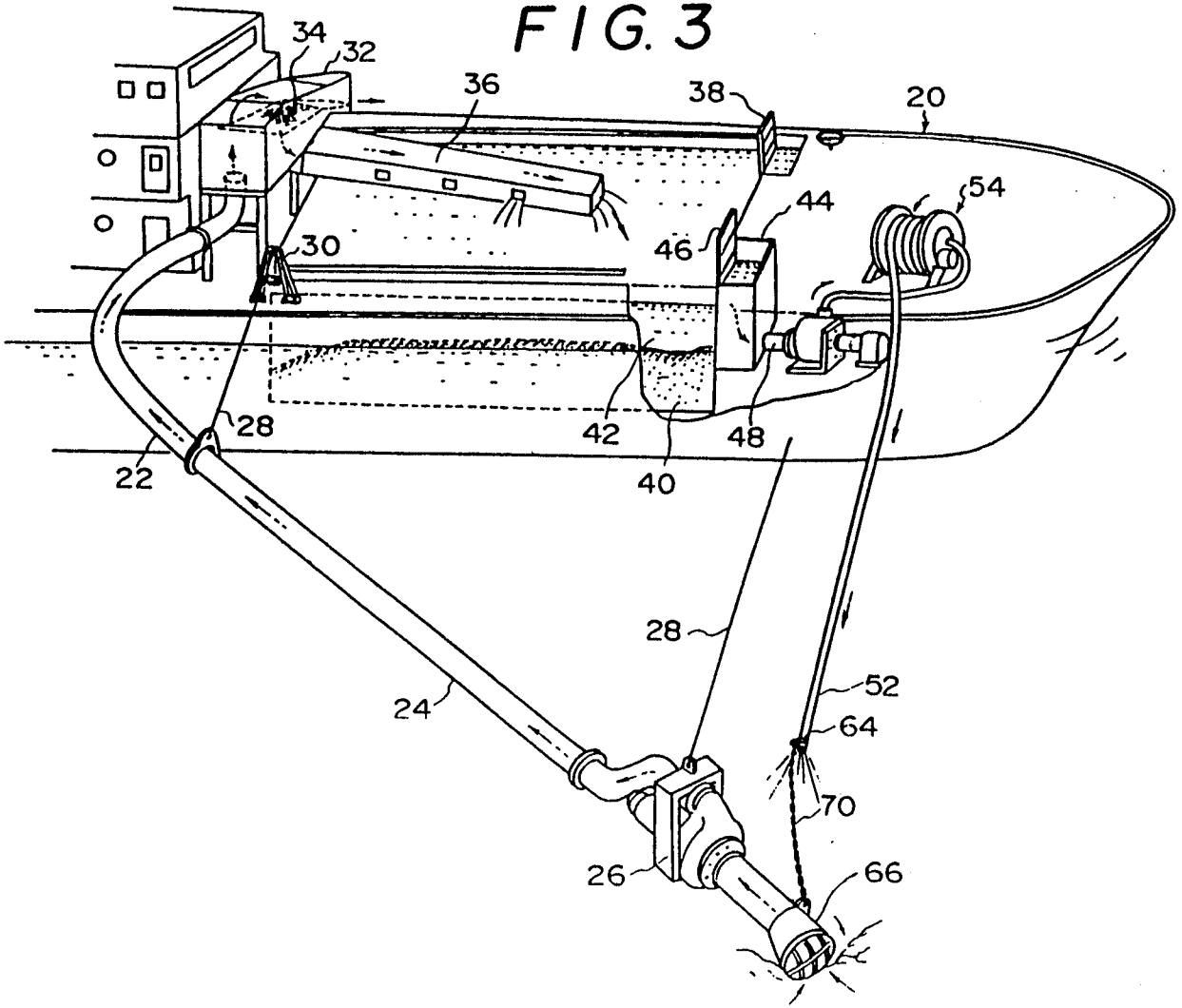
FIG. 3 is a perspective view of a second embodiment of the apparatus of the present invention.

A second embodiment of the present invention will be described with reference to FIG. 3. This embodiment is suitable for use in the case where sand is collected at a large depth from the sea water surface. This embodiment is similar to the first embodiment described before but is different in that the connection between the discharge end of the discharge hose 52 to the suction mouth 66 is accomplished by a chain or a wire rope 70, unlike the first embodiment which employs a special connection jig 68. Other portions of the second embodiment are substantially the same as those in the first embodiment and are denoted by the same reference numerals as those in the first embodiment and description of such portions is omitted.

The depth at which the sand is gathered varies according to the configuration of the sea bottom. When the depth is large, it is not essential that the muddy water is directed towards the suction opening of the sand pump 26 for recirculation, because in such a case the risk for the muddy water 42 to float to the surface region or to reach seashore is negligibly small. On the other hand, when the sand gathering system has to cover a variety of depth from small to large depths, the system is required to have the discharge hose 52 of a large length so that the size of the take-up drum 54 is increased, as well as the resistance produced by the water when the discharge hose is moved in the water. In the second embodiment, therefore, the length of the discharge hose 52 is limited to a certain length and the end of the discharge hose 52 is connected to the chain or the wire rope 70 to the suction end of the sand pump 26, so that the discharge end of the discharge hose 52 is maintained at a predetermined distance from the suction opening of the suction pump when the sand is collected from the sea bottom of a depth which is greater than the length of the discharge hose 52. It is possible to prepare a plurality of chains or wire ropes or to suitably increase and decrease the number of links of the chain so as to adapt the discharge system to a variety of depth.

Figure 4:
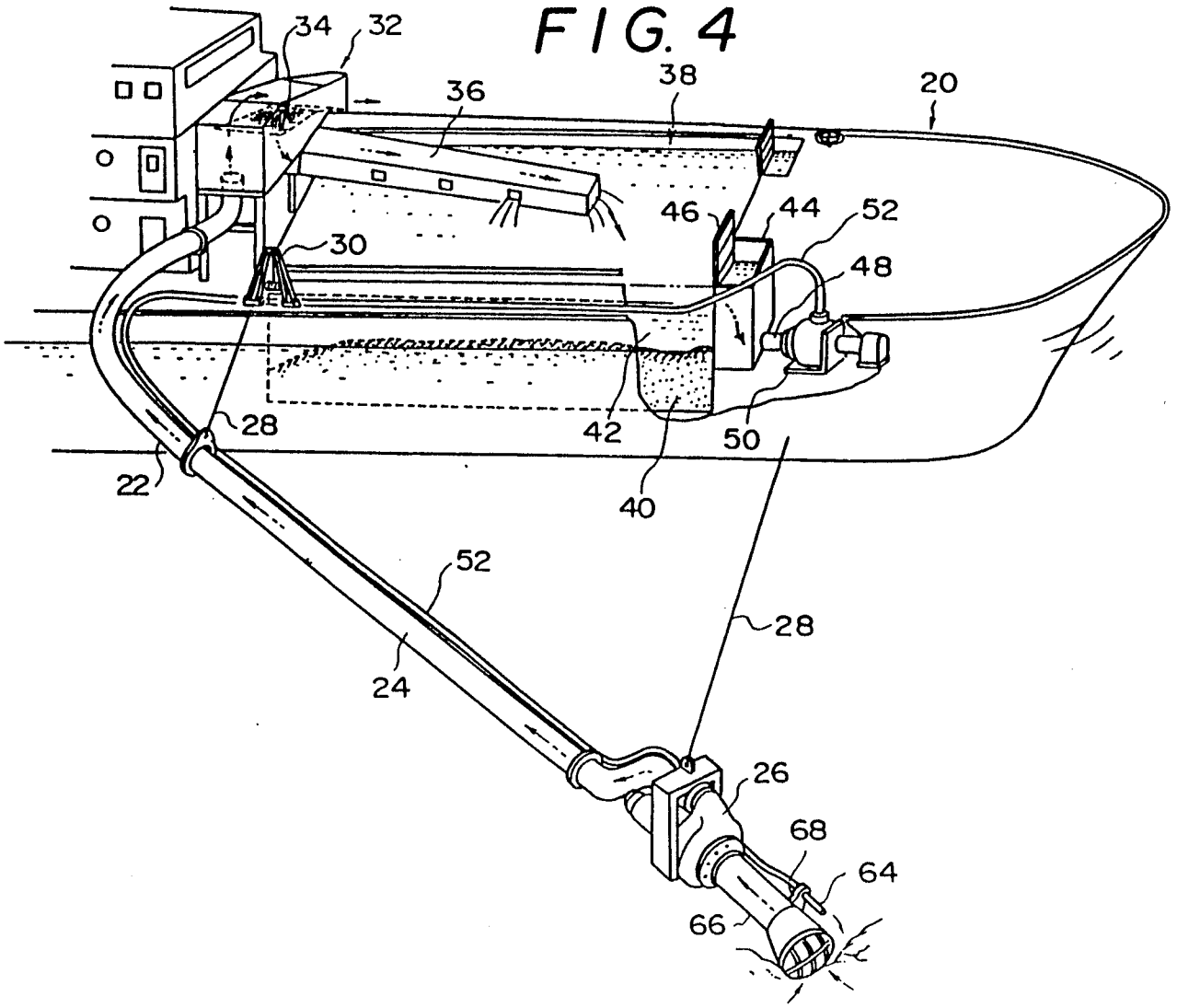
FIG. 4 is a perspective view of a third embodiment of the apparatus of the present invention.

FIG. 4 shows a third embodiment in which the hose take-up device such as the take-up drum 54 used in the preceding embodiments is eliminated. In this embodiment, the discharge hose 52 or pipe leading from the discharge pump 50 is extended along and fixed to the same pipe 24 and the hose 22 connected to the submerged sand pump 26, with the end of the discharge hose or pipe fixed to the suction mouth 66, whereby the discharge opening of the discharge hose 52 and the inlet of the suction mouth 66 is located in the close proximity of each other so as to allow recycling of the muddy water 42.

Obviously, the apparatus of the present invention can be applied to a sand gathering system of so-called suction pump type which employs a sand pump 26 on board rather than a submerged pump. In this case, the suction mouth 66 alone is laid on the sea bottom through a suction pipe.

It will be clear to those skilled in that art that the invention can equally be applied to sand gathering systems which are used in lakes, ponds, dams or the like, through a system for gathering sand from sea bottom has been specifically described. Although in the described embodiments the muddy water is recycled, this is only illustrative and the invention maybe carried out by lowering the discharge hose 52 alone such that the discharge opening 64 is set near the sea bottom so as to discharge the muddy water into a deep region near the sea bottom. Such an arrangement also is effective in preventing contamination of the surface region of sea water and damaging of marine products such as fishes in culture or fishery areas.

Figure 5:
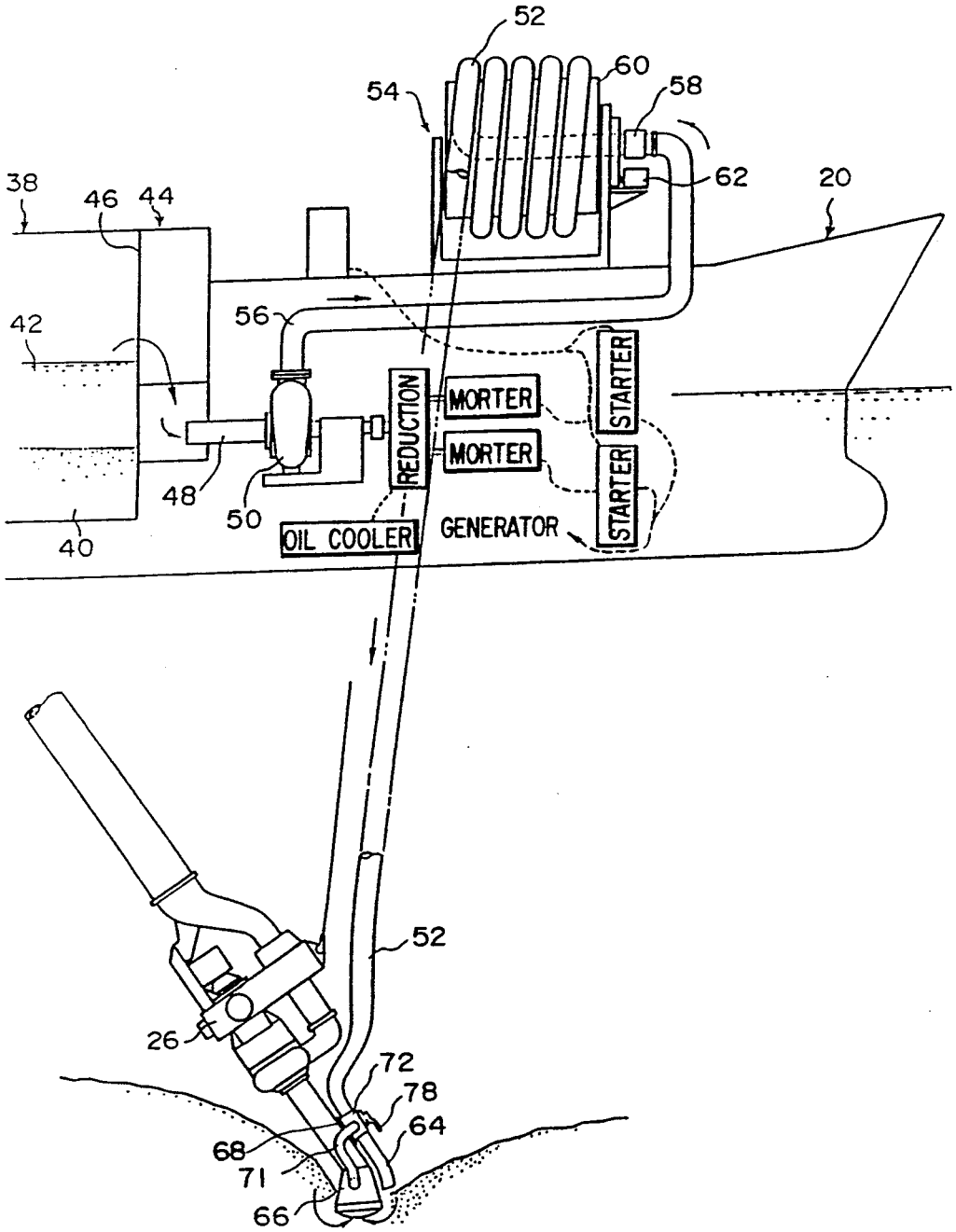
FIG. 5 is a side elevational view of a critical portion of a fourth embodiment of the apparatus of the present invention.

A fourth embodiment of the present invention will be described with reference to FIG. 5. In this embodiment, the discharge opening 64 of the discharge hose 52 is directly connected to the suction mouth 66 which forms the suction opening of the sand pump 26, so as to discharge the muddy water 42 from the discharge tank 44 into the sucking zone in the suction mouth 66.

Figure 6:
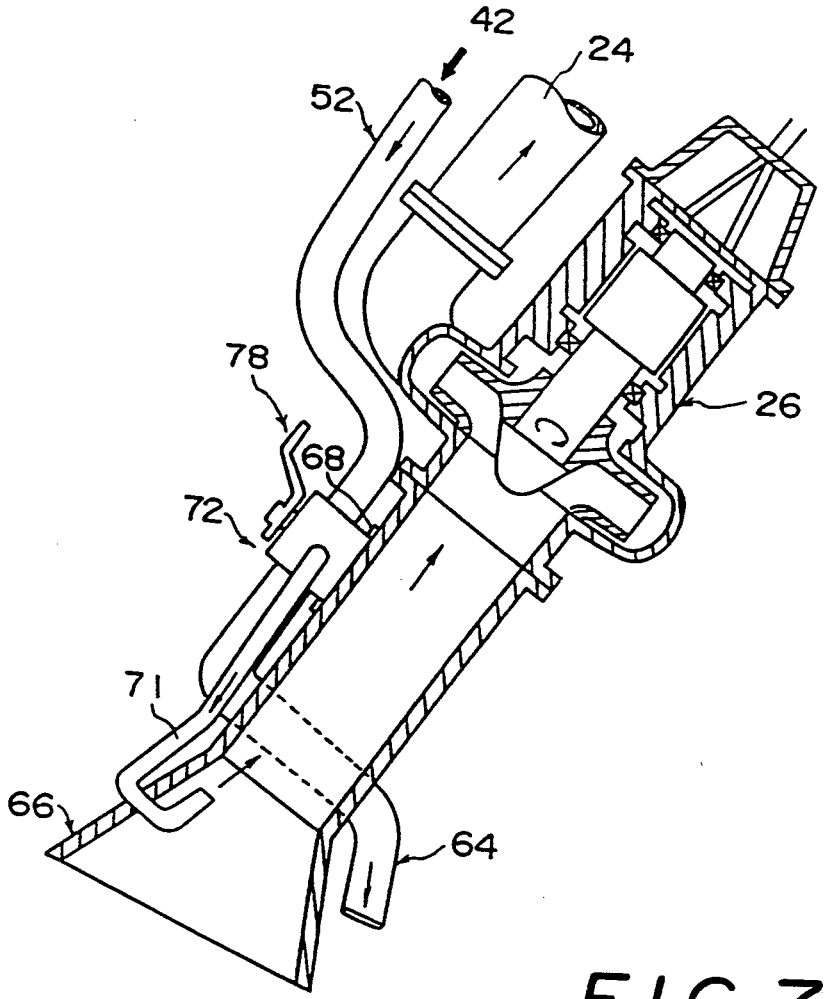
FIG. 6 is a sectional view of a branching portion of a discharge hose.
Figure 7:
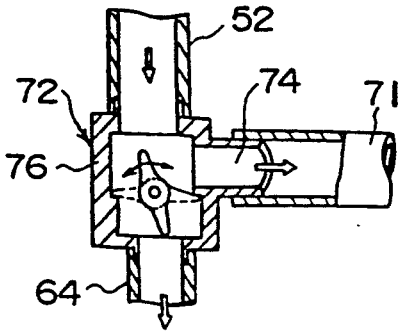
FIG. 7 is a sectional view of a shunt valve.

The discharge hose leading to the suction mouth is branched into two portions: a portion leading to the discharge opening 64 and an ejector pipe 71. This arrangement is shown in more detail in FIG. 6. Referring to this Figure, a connecting jig 68 for fixing the discharge hose 52 is provided with a shunt valve 72. The discharge hose 52 communicates with the discharge opening 64 through this shunt valve 72. The shunt valve 72 has a shunt passage 74 as shown in FIG. 7. The ejector pipe 71 is connected to the shunt passage 74. The shunt valve 72 has a butterfly type construction and is operated by a rotation of an operation lever 78 provided externally of the valve housing 76, so as to direct the muddy water to either one or both of the discharge opening 64 and the ejector pipe 71. The ejector pipe 71 is extended straight towards the extreme end of the suction mouth 66 and is bent in a U-like form into the suction mouth 66 so as to be opened in the latter. The opening of the ejector pipe is oriented in the direction of suction of sand by the sand pump 26 so that the muddy water 42 pressurized by the discharge pump 50 is supplied into the sand pump 26.

In the sand gathering system employing the illustrated embodiment of the invention, the sand gathering operation is conducted in a manner which will be explained hereinunder. As the discharge pump 50 is operated, the muddy water 42 is moved towards the sea bottom through the discharge hose 52. If the shunt valve 72 provided at the branching portion of the discharge hose 52 has been set to connect the discharge hose to the discharge opening 64, the muddy water 42 is released to a region near the sucking zone of the suction mouth 66. The greater the depth of the suction mouth 66 from the sea water surface, the smaller the tendency for the muddy water to be spread to the surface region of the sea. In addition, the released muddy water 42 is sucked again by the sucking force of the sand pump 26 developed in the suction mouth 66, so as to be recycled to the sand tank 38.

When the sand slurry sucked through the suction mouth 66 has high concentration of sand, the operator operates the shunt valve 78 so as to select the ejector pipe 71. Consequently, the suction pressure of the sand pump 26 developed in the suction mouth 66 is boosted by the discharge pressure of the discharge pump 50, whereby clogging of the suction mouth 66 with sand is avoided without fail and, in addition, the space inside the suction mouth 66 is cleaned. Furthermore, the entire portion of the muddy water containing fine sand particles is recycled to the sand tank 38, so as to improve the yield of the sand while preventing diffusion of the muddy water completely.

In the described sand gathering system, the water level in the sand tank 38 is above the discharge pump, so that the priming of the suction sand pump is eliminated to remarkably facilitate the operation.

Thus, in the fourth embodiment as described, the ejector pipe 71 connected to the discharge pipe 52 through the shunt valve 72 is selectively operated to produce a boosting effect on the sand pump 26. It is therefore possible to improve the suction efficiency of the sand pump, while reducing the load on the sand pump, even when the slurry sucked by the pump has a high sand concentration.

Figure 8:
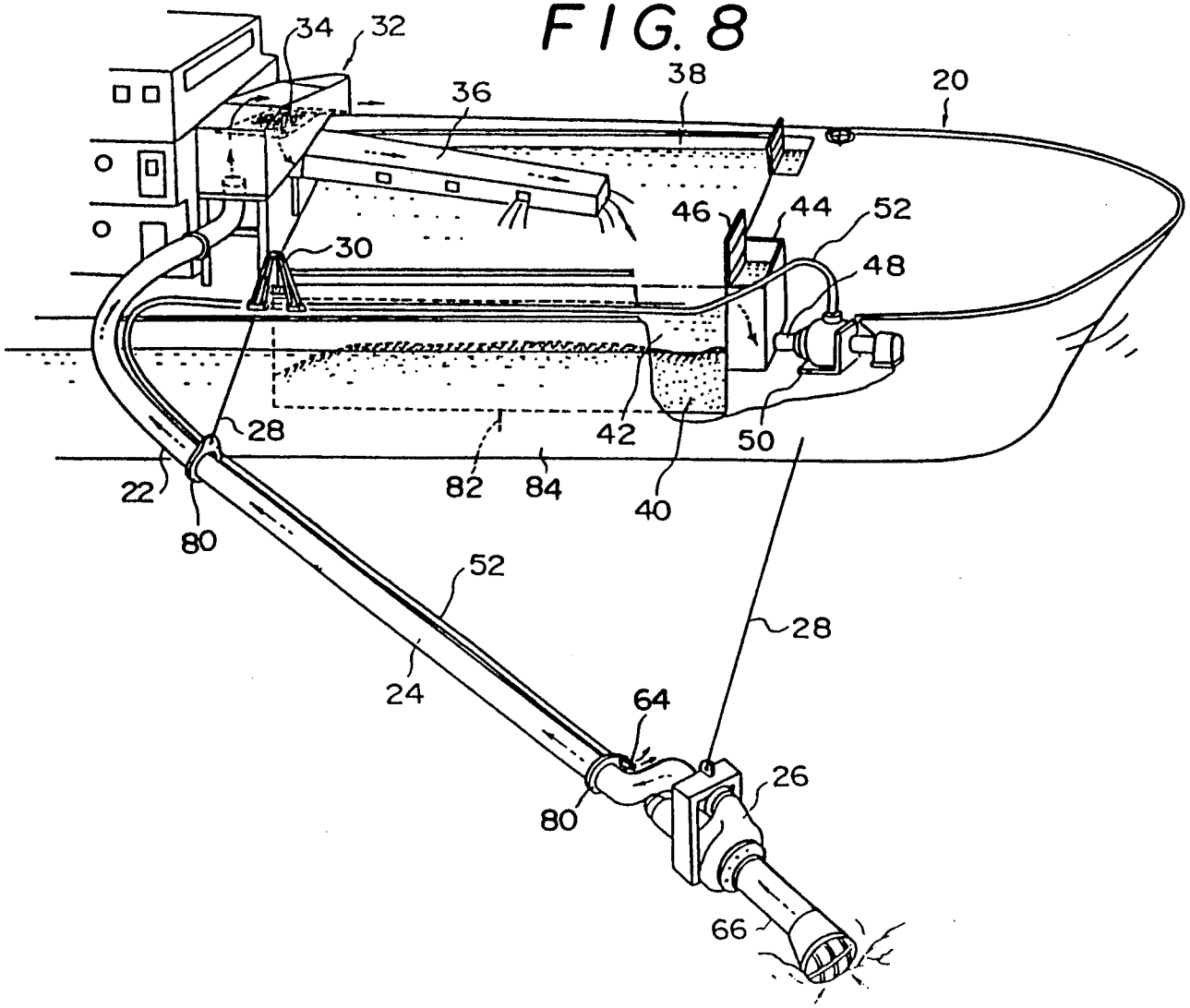
FIG. 8 is a perspective view of a fifth embodiment of the apparatus of the present invention.

FIG. 8 shows a fifth embodiment of the present invention. In this embodiment, a discharge pipe 52, a portion of which is made of steel pipe, is connected to the discharge port of a discharge pump 50 capable of forcibly discharging muddy water 42 from the discharge tank 44. This discharge pipe 52 is an elongated pipe having one end connected to the discharge pump 50 on board. The discharge pipe 52 is laid on the hull of the sand gathering boat 20 so as to be led to the hose 22 on the upper end of the sand transfer pipe 24. The discharge pipe 52 is laid in a side-by-side relation to the hose 22, is united with the sand transfer pipe 24 leading to the submerged sand pump 26, and is fixed to and opened in an assembly portion of the submerged sand pump 26 including parts for suspending the sand transfer pipe 24. In consequence, when the submerged sand pump 26 with a suction mouth 66 is lowered towards the sea bottom for the purpose of gathering the sand, the end of the discharge pipe 52 having the discharge opening 64 is moved to follow up the movement of the suction mouth 66 so as to be able to discharge the muddy water to a region near the suction mouth 66. In this embodiment, the portion of the discharge pipe 52 extending in parallel with the steel sand transfer pipe 24 is made of steel and united with the pipe 24 by means of fixing members 80, whereby both the discharge pipe 52 and the sand transfer pipe 24 are handled to be moved into and out of water as a unit with each other.

In the described embodiment of the apparatus of the invention for preventing diffusion of muddy water, the muddy water separated from gathered sand is discharged to a deep region near the bottom of the sea, so that the fine particles suspended by this muddy water are allowed to precipitate onto the sea bottom without being diffused to the surface region, thus preventing various troubles which may otherwise be caused by diffusion of the muddy water. The fifth embodiment also offers the following advantages.

When the submerged sand pump 26 is lowered to be seated on the sea bottom, the sand transfer pipe 26, sand pump 26, suction mouth 66 and the muddy water discharge pipe 52 are moved downward into the sea as a unit. Thus, the discharge end of the discharge pipe 52 having the discharge opening 64 is moved up and down together with the submerged sand pump 26, thus eliminating necessity for laborious work for independently operating the muddy water discharge pipe 52 for setting the discharge opening 64.

Furthermore, in this embodiment, the duration or time for the discharge of the muddy water is substantially equal to the duration or time in which the submerged sand pump 26 is situated on the sea bottom, i.e., the duration of the sand gathering operation. A more detailed description will be given in this connection. 1) The generation of muddy water occurs during the operation of the submerged sand pump 26 on the sea bottom. 2) The submerged sand pump 26 is stopped when the sand tank is filled up with sand and water. Thereafter, it is necessary to discharge, by means of the discharge pump 50, any portion of the muddy water which has exceeded the levels of the gates 38, 46 of the discharge tank 44. However, residual muddy water remaining in the sand tank 38 is filtrated by the sand layer in the sand tank so as to become freshwater and is drained into a bilge tank 84 through a drain port 82 formed in the bottom of the sand tank. Therefore, the discharge pump 50 is kept running several minutes after the stop of the submerged sand pump 26, before the submerged sand pump 26 is lifted.

It will be understood that the discharge end of the muddy water discharge pipe can conveniently be moved up and down by the operation for lifting and lowering the submerged sand pump.

This makes it possible to omit components such as the reel for coiling the discharge pipe 52 and the reel driving motor, and to eliminate any restriction from the view point of strength of the water discharge pipe. Consequently, inexpensive materials can be used for the discharge pipe. Furthermore, since the discharge pipe is united with the sand transfer line, it is not substantially resisted by water when it moves together with the sand transfer line or is interfered with other parts, as compared with the case where the muddy water discharge pipe is arranged separately from the sand transfer line.

Figure 9:
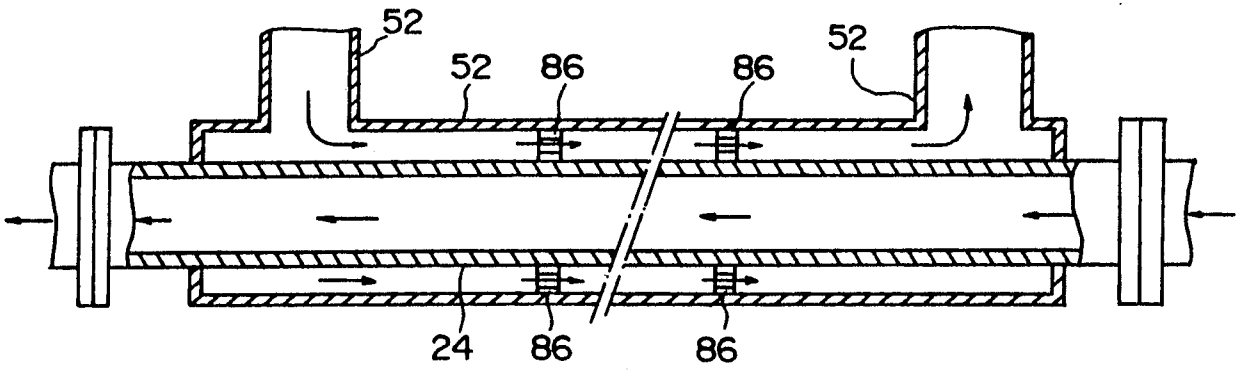
FIG. 9 is a sectional view of a modified sand transfer pipe.
Figure 10:
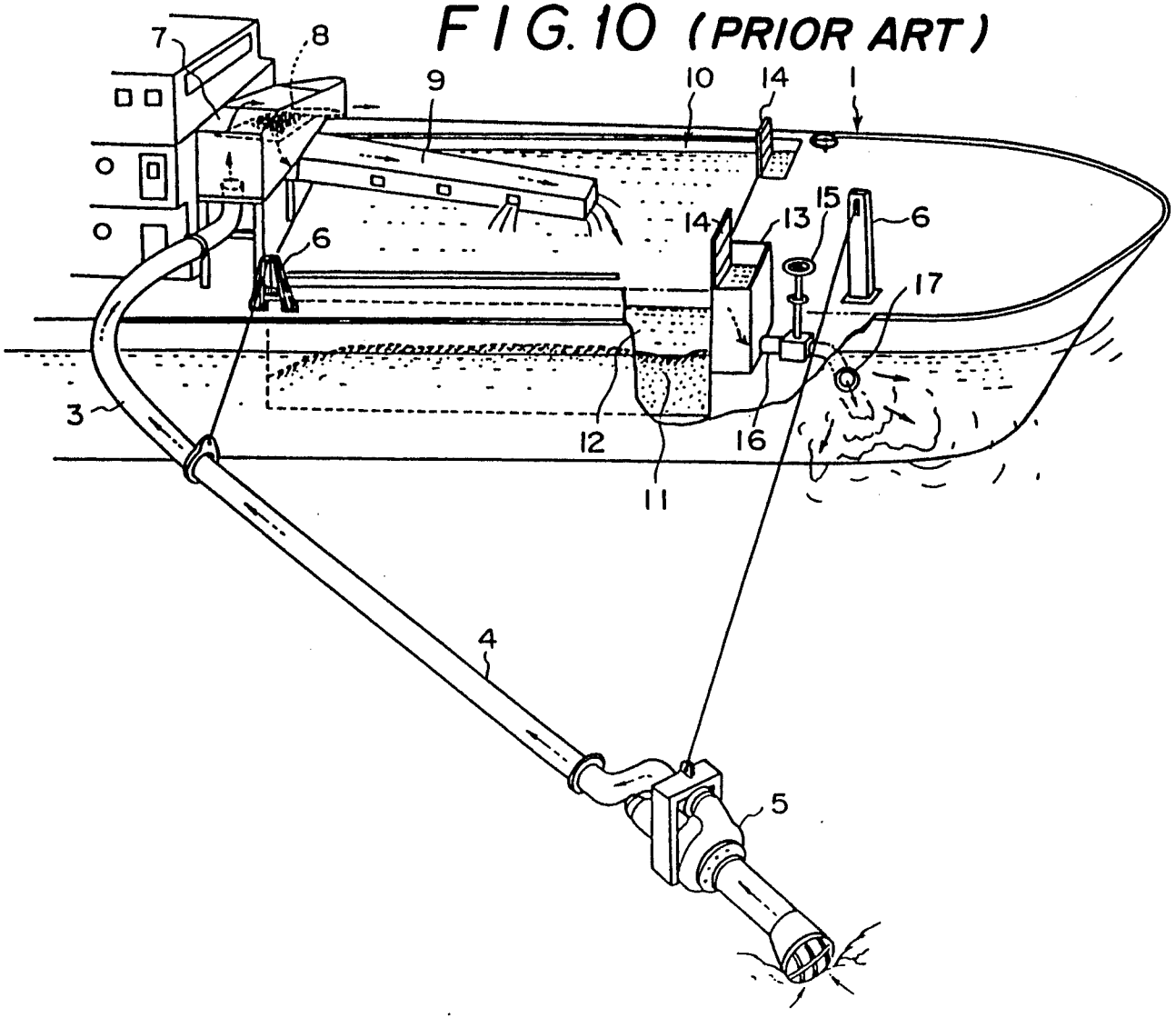
FIG. 10 (PRIOR ART)
FIG. 10 is a perspective view of a conventional apparatus.

FIG. 9 shows a modification in which the discharge pipe 52 and the sand transfer pipe 24 are integrated with each other by the use of a double-walled pipe structure, in place of being fixed at a plurality of points along the sand transfer pipe 24. The double-walled pipe structure is composed of an outer pipe serving as the muddy water discharge pipe 52 through which muddy water displaced by the discharge pump 50 flows towards the discharge opening as indicated by an arrow, and an inner pipe serving as the sand transfer pipe 24 through which the sand slurry flows from the submerged sand pump 26 towards the same tank 38. Both pipes 24 and 52 are supported on each other through perforated spacers 86.

This modification having the double-walled pipe structure integrating the muddy water discharge pipe 52 and the sand transfer pipe 24 produces the same effect as that brought about by the embodiment described before in connection with FIG. 8. Particularly, the resistance produced by water during movement of the muddy water discharge pipe can be remarkably decreased.

The muddy water discharge pipe may be laid along and fixed to the sand transfer pipe even when the whole sand transfer pipe is composed of a flexible hose.

In the fifth embodiment shown in FIG. 8, as well as in the modification shown in FIG. 9, the muddy water discharge pipe can be laid automatically when the sand pump and the sand transfer pump are laid on the sea bottom. Therefore, any separate driving and hoisting devices exclusive for the muddy water discharge pipe are dispensed with. In addition, the efficiency of the work is improved because the muddy water discharge pipe can be set automatically when the sand transfer pipe and the sand pump are set. Furthermore, the muddy water discharge pipe integrated with the sand transfer pipe reduces the resistance produced by water almost to half produced when the muddy water discharge pipe is constructed and laid separately from the sand transfer pipe. This also offers an advantage in that the stability and steerability of the boat mounting the sand gathering system is improved.

What is claimed is:

1. An apparatus for preventing diffusion of muddy water in a sand gathering system, comprising:

a suction opening for collecting a mixture of solids and water from a floor of a body of water;

a sand pump adjacent said suction opening for pumping said mixture;

a transport line for transporting said mixture;

a sand gathering boat for receiving said mixture from said transport line;

a sand tank in said sand gathering boat for collecting and precipitating solids in said mixture and for separating from said mixture muddy water having a low concentration of solids relative to said mixture;

a discharge tank adjacent said sand tank for receiving said muddy water from said sand tank;

a discharge pump for discharging said muddy water from said discharge tank; and a discharge pipe for returning said muddy water from said discharge tank; wherein the discharge pipe further comprises a shunt valve, such that the discharge pipe is branched into two sections by the shunt valve, one of the two sections exiting within the suction opening, and an other of the two sections exiting at a location adjacent to the suction opening to define a partially open circuit for permitting said suction opening to collect muddy water returned from said discharge tank and water from said body of water.

2. The apparatus of claim 1, wherein said transport line and said discharge pipe form a double-wall hose in which one of said lines is surrounded by the other.

3. The apparatus of claim 1, wherein said transport line and discharge pipe are adjacent one another over substantially their entire length.

4. The apparatus of claim 1, further comprising means for holding said discharge pipe in the location adjacent the suction opening.

5. The apparatus of claim 1, further comprising a drain port at the bottom of the sand tank, said drain port exiting into a bilge tank of the sand gathering boat.

6. The apparatus of claim 1, wherein the other of the two sections of the discharge pipe from the shunt valve releases the muddy water from the discharge tank to a location adjacent to the floor of the body of water.

7. A method for preventing the diffusion of muddy water in a sand gathering system, comprising:

collecting a mixture of solids and water from the floor of a body of water through a suction opening;

transporting the collected mixture to a sand tank of a sand gathering boat;

precipitating solids of the mixture in the sand tank to separate from said mixture muddy water having a low concentration of solids relative to said mixture;

transferring the muddy water having the low concentration of solids relative to said mixture from the sand tank to a discharge tank when a level of water in the sand tank has reached a predetermined level;

discharging the muddy water from the discharge tank; and branching the muddy water into a first section and a second section by a shunt valve, wherein the first section of muddy water is discharged into the suction opening and the second section of muddy water is discharge to the body of water at a location adjacent to and outside of the suction opening where said mixture is being collected.

8. The method of claim 7, wherein said transporting and discharging steps are performed by transporting and discharging lines, one of said lines being within the other line.

9. The method of claim 7, wherein said transporting and discharging steps are performed by transporting and discharging lines which are adjacent one another over a substantially entire length of the lines.

10. The method of claim 7, further comprising the step of collecting clean water in a bilge tank by passing the muddy water through collected sand in the sand to a drain port which leads to the bilge tank.

11. The method of claim 7, wherein the second section of muddy water is discharged at a location adjacent to the floor of the body of water.

* * * * *